United States Patent [19]

Ekman

[11] Patent Number: 4,649,897

[45] Date of Patent: Mar. 17, 1987

[54] VAPORIZER-BURNER

[75] Inventor: Heinz Ekman, Kirkkonummi, Finland

[73] Assignee: Scan-Development KY, Järvenpää, Finland

[21] Appl. No.: 796,783

[22] Filed: Nov. 12, 1985

[51] Int. Cl.[4] ..... F24C 3/00

[52] U.S. Cl. ..... 126/332; 126/337 R; 126/338

[58] Field of Search ..... 431/331, 332, 333, 337, 431/338, 339, 351, 352

[56] References Cited

U.S. PATENT DOCUMENTS

| | | | |
|---|---|---|---|
| 55,072 | 5/1866 | Doty | 137/875 |
| 1,639,202 | 8/1927 | Valjean | 431/337 |
| 1,764,529 | 6/1930 | Rutter | 431/332 |
| 4,519,769 | 5/1985 | Tanaka | 431/352 |

*Primary Examiner*—Carroll B. Dority, Jr.
*Attorney, Agent, or Firm*—Browdy and Neimark

[57] ABSTRACT

A vaporizer-burner using liquid fuel such as oil, in which the oil conducted to the combustion chamber is vaporized before being ignited and in which the air required for combustion has been conducted to the combustion chamber along a separate duct. The problem in this type of vaporizer-burners of prior art is the continuous vacuum prevailing in the combustion chamber during operation, which renders the flame unstable and sensitive to changes in ambient conditions, such as wind squalls. With the vaporizer-burner of the invention, the problem has been solved in that the air supply duct has been divided into two parts, one directing air to the oil vaporizing process and the other to the combustion process, and that the supply proportion of said so-called primary and secondary airs can be adjusted with the aid of a turnable flap placed in the duct.

10 Claims, 2 Drawing Figures

PRIOR ART

VAPORIZER-BURNER

BACKGROUND OF THE INVENTION

The present invention concerns a vaporizer-burner using liquid fuel such as oil, in which the oil conducted to the combustion chamber is vaporized before ignition and in which the air needed for combustion is conducted to the combustion chamber through a separate duct with the aid of a blower or equivalent.

Burners of this kind are used particularly in small houses for the heating of heating boilers. An advantage of said burner type is that it can be used also at very low capacity levels at which the effeciency, otherwise good, is known to suffer. In vaporizer-burners of prior art, the oil is conducted to the lower part of the combustion chamber, where it is heated above the boiling point, whereby the oil is vaporized. The vaporized oil is ignited and air is conducted to the flame along a separate air supply duct. The supply of the air may take place with or without a blower. The efficiency of the vaporizer-burners is usually good, but they are more or less unreliable in operation because in the combustion chamber vacuum prevails all the time. A sudden squall of wind may be enough to impair the operation of the burner.

OBJECT OF THE INVENTION

The object of the present invention is to provide a vaporizer-burner which is more reliable in operation and has higher efficiency than before. The vaporizer-burner of the invention is therefore characterized in that the air supply duct has been divided into two parts, one directing air to the oil vaporization process and the other to the combustion process, and that the proportion at which these so-called primary and secondary air flows are supplied can be regulated with the aid of a turnable flap placed on the duct. With the aid hereof, burning event can be adjusted and the burning will be more complete.

An advantageous embodiment of the invention is characterized in that on the cylindrical inner wall of the combustion chamber has been mounted a metallic ring running substantially around the entire circumference, the heat stored therein being conducted downwards along the wall of the combustion chamber to the oil vaporizing step. This saves some of the energy required to vaporize the oil.

Another advantageous embodiment of the invention is characterized in that a water supply pipe has been connected to the combustion chamber and arranged to spray water into the chamber at regular intervals during the process for burning up soot and other impurities from the walls of the chamber. Therefore, the combustion chamber need not be emptied of oil during the cleaning.

BRIEF DESCRIPTION OF THE DRAWINGS

In the following, the invention is described in detail with the aid of an example, referring to the drawings attached, in which.

DETAILED DESCRIPTION OF THE PREFERRED EMBODIMENT

Figure 1:
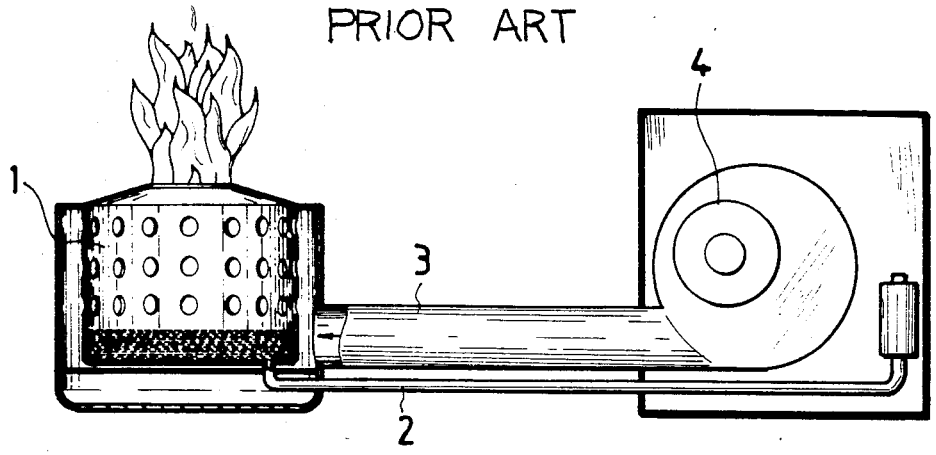
FIG. 1 presents schematically a vaporizer-burner of prior art.

The principle design of the vaporizer-burners known in the art is presented in FIG. 1. Therein, oil supply 2 and air supply 3 have been provided to the combustion chamber 1. For intensifying the air supply, a blower 4 has been provided in the duct.

In the vaporizer-burner of the invention, the air supply has been divided into two parts 5, 6 by disposing a baffle plate 7 in the air supply duct, this plate being arranged in susch manner vertically in relation to the combustion chamber 1 that it is located below the flame. Along the lower air supply duct 5, the air goes to the oil vaporizing step and along the upper supply duct, to the combustion step. The air going to the vaporizing step is here called the primary air and the air going to the flame is called the secondary air. For regulating the proportion of their supplies, a turning flap 8 has been arranged at the front margin of the baffle plate 7. By altering its position, the ideal supply proportion of primary and secondary air can be effected. In experiments that have been carried out, it has been found that it is possible to avoid the vacuum which is present in the combustion chamber of existing vaporizer-burners..

The oil supply to the bottom of the combustion chamber is by the pipe 2. The lower part of the combustion chamber 1 is so heated that the oil conducted into it is heated higher than its boiling point and is vaporized. The vaporized oil ascends and is ignited at this moment. The supply proportion of primary and secondary air is regulated and so adjusted that the flame is steady.

Figure 2:
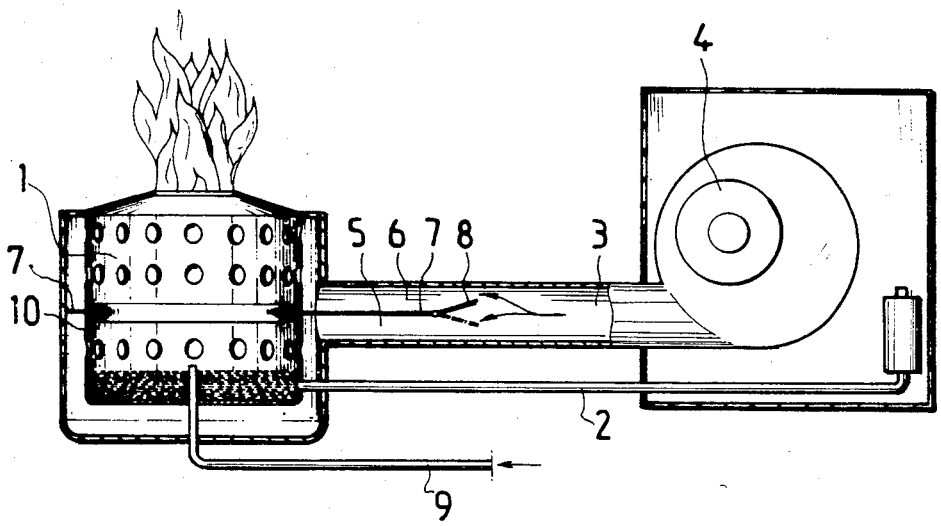
FIG. 2 presents the vaporizer-burner of the invention.

As can be seen in FIG. 2, the combustion chamber 1 of the vaporizer-burner of the invention is provided with a metallic ring 10 running around its cylindrical inner wall. This ring conducts the heat which it has stored to the lower part of the combustion chamber, where the vaporizing of the oil takes place. Hereby, saving of heating energy is achieved.

In the advantageous embodiment of the vaporizer-burner of the invention presented in FIG. 2, the combustion chamber of the vaporizer-burner has been provided with a water supply 9. Water is sprayed therethrough into the combustion chamber at regular intervals. The spraying is accomplished while the vaporizer-burner is in operation, when the combustion chamber is very hot and the water evaporates at once and burns away any soot and other impurities from the walls of the combustion chamber.

It is obvious to a person skilled in the art that the invention is not restricted to the embodiment example given in the foregoing and that it may be modified within the scope of the claims stated below.

I claim:

1. A vaporizer-burner for use with a liquid fuel such as oil, comprising:

a housing including an interior peripheral surface, a combustion chamber, including a perforated exterior peripheral surface, disposed within said housing, said combustion chamber including a vaporization portion and an ignition portion, said interior peripheral surface of said housing and said exterior peripheral surface of said combustion chamber being separated from one another to define therebetween a gap;

a liquid fuel source including means for conducting said liquid fuel to said vaporization portion of said combustion chamber, an air source including a duct for conducting air from said air source to said gap, said duct supporting therein means, extending along a portion of the length of said duct, for dividing air flowing in said duct into a primary flow and a secondary flow, said dividing means having one end projecting into said gap and an opposing end including adjustable means for simultaneously altering the amounts of said primary and secondary flows, and means, extending across said gap from said housing interior peripheral surface to said combustion chamber exterior peripheral surface, for separating said gap into a first portion for receiving said primary flow and a second portion for receiving said secondary flow, said separating means being coextensive with said dividing means one end projecting into said gap, whereby upon adjustment of said altering means, the proportion of said primary and secondary flows can be simultaneously selected, and the efficiency of burning of the liquid fuel can be optimized.

2. The vaporizer-burner of claim 1, wherein said vaporization portion of said combustion chamber is disposed within said first portion of said gap and communicates with said primary flow, and said ignition portion of said combustion chamber is disposed within said second portion of said gap and communicates with said secondary flow.

3. The vaporizer-burner of claim 1, and further including means for conducting bent to said vaporization portion of said combustion chamber to enhance vaporization of said liquid fuel.

4. The vaporizer-burner of claim 3, and further including means for spraying water into combustion chamber, when said vaporizer burner is in operation, for burning away impurities from interior surfaces of said combustion chamber.

5. The vaporizer-burner of claim 4, wherein said spraying means includes means for spraying water at regular intervals.

6. The vaporizer-burner of claim 4, wherein said spraying means communicates with the vaporization portion of said combustion chamber.

7. The vaporizer-burner of claim 4, wherein said spraying means sprays water into both the vaporization portion of said combustion chamber and the ignition portion of said combustion chamber.

8. In an apparatus for burning a liquid fuel such as oil, including a combustion chamber having a perforated vaporization portion in which the liquid fuel is vaporized and a perforated ignition portion in which the vaporized liquid fuel is burned, and means for conducting the liquid fuel to the vaporization portion, the improvement comprising:

a housing disposed about, and spaced from, said combustion chamber to define a gap therebetween, means for conducting air under pressure to said gap, said air conducting means housing means, extending along a portion thereof, for selectively separating air flowing therein into a primary flow and a secondary flow, means, extending across said gap from said housing to said combustion chamber, for dividing said gap into a first subchamber, located adjacent said vaporization portion, for receiving said primary flow and a second subchamber, located adjacent said ignition portion, for receiving said secondary flow, said dividing means including a portion connected to said separating means, and water spraying means for spraying water into said combustion chamber, so that when said apparatus is in operation, impurities on interior surfaces of said combustion chamber are burned away, whereby during operation of the apparatus, optimization of the efficiency of vaporization and burning of the liquid fuel may be achieved by selection of an optimum proportion of primary flow to secondary flow, simultaneously with achieving continuous cleaning of the combustion chamber.

9. The improvement of claim 8, wherein said dividing means comprises means for simultaneously storing heat from said ignition portion of said combustion chamber and conducting said stored heat to said vaporization portion of said combustion chamber, whereby vaporization of said liquid fuel is optimized.

10. The improvement of claim 8, wherein said water spraying means includes means for spraying water at regular intervals.

* * * * *